US005623887A

United States Patent [19]

Tajima et al.

[11] Patent Number: 5,623,887

[45] Date of Patent: Apr. 29, 1997

[54] THREAD CUTTING DEVICE IN SEWING MACHINE

[75] Inventors: Ikuo Tajima; Tomoaki Anezaki; Masayoshi Hirate; Masaru Akao, all of Kasugai, Japan

[73] Assignee: Tokai Kogyo Mishin Kabushiki Kaisha, Kasugai, Japan

[21] Appl. No.: 462,490

[22] Filed: Jun. 5, 1995

[30] Foreign Application Priority Data

Jul. 29, 1994 [JP] Japan ..... 6-178769
Feb. 9, 1995 [JP] Japan ..... 7-021937

[51] Int. Cl.[6] ..... D05B 65/02

[52] U.S. Cl. ..... 112/291; 112/300

[58] Field of Search ..... 112/291, 292, 112/285, 289, 296, 297, 298, 300

[56] References Cited

U.S. PATENT DOCUMENTS 5,131,340 7/1992 Tajima et al. ..... 112/292
5,249,536 10/1993 Hattori et al. ..... 112/292 X
5,522,331 6/1996 Stutznacker ..... 112/289

FOREIGN PATENT DOCUMENTS 267980 5/1990 Japan .

*Primary Examiner*—Peter Nerbun
*Attorney, Agent, or Firm*—Dennison, Meserole, Pollack & Scheiner

[57] ABSTRACT

A thread cutting device in a sewing machine includes a movable knife which is movable across a space between a throat plate and a shuttle positioned below the throat plate so as to perform a thread cutting operation. A lower thread retreating lever is movable from a waiting position to an operative position for retreating a lower thread taken out from the shuttle to a position out of a thread cutting orbit of the movable knife. The thread cutting device is operable in either a thread cutting mode for cutting both an upper thread and a lower thread or a thread cutting mode for cutting only the upper thread by selectively positioning the lower thread retreating lever at either the waiting position or the operative position during the operation of the movable knife. An actuator and an interlocking mechanism between the actuator and the lower thread retreating lever are provided for driving the lower thread retreating lever. The actuator and the interlocking mechanism are positioned rearwardly of the shuttle.

12 Claims, 16 Drawing Sheets

THREAD CUTTING DEVICE IN SEWING MACHINE

BACKGROUND OF THE INVENTION

1. Field of the Invention

The present invention relates to a thread cutting device in a sewing machine and particularly to a thread cutting machine which is operable to selectively cut both an upper thread and a lower thread and to cut only an upper thread.

2. Description of the Prior Art

A conventional thread cutting device in a sewing machine is disclosed in Japanese Laid-Open Utility Model Publication No. 2-67980 and includes a movable knife which is operable to cut both upper and lower threads through a reciprocal swinging movement across a space between a throat plate and a shuttle positioned below the throat plate. A lower thread retreating lever is swingably movable from a waiting position to an operative position, so that the lower thread is retreated from a thread cutting orbit of the movable knife. Thus, when the lower thread retreating lever is held at the waiting position, both the upper and lower threads are cut through movement of the movable knife. On the other hand, when the lower thread retreating lever has been moved from the waiting position to the operative position, only the upper thread is cut by the movable knife.

However, with this conventional thread cutting device, an actuator (a rotary solenoid) and its associated interlocking mechanism (a link mechanism) are disposed forwardly of the shuttle. Therefore, parts of these mechanisms may prevent an operation for changing a lower thread bobbin to another one or an operation for oiling the shuttle. Additionally, it is difficult to secure a space for mounting a lower thread detecting device.

Further, with the conventional thread cutting device, a setting operation of selection between two thread cutting modes, one for cutting both the upper and lower threads and the other for cutting only the upper thread is performed in connection with each cutting point during a sewing operation (an embroidery operation). Otherwise, in preparing sewing data (embroidery data), data with respect to selection between two thread cutting modes are set to be included in the sewing data. In these cases, a seriously troublesome amount of work is required for the setting operation if a number of thread cutting points are included in a pattern to be embroidered such as an embroidery pattern including a number of pattern parts.

SUMMARY OF THE INVENTION

It is, accordingly, an object of the present invention to provide a thread cutting device in a sewing machine which improves the operation of changing a lower thread bobbin positioned within a shuttle to another one, of oiling the shuttle and which secures a sufficient space for mounting a lower thread detecting device.

It is another object of the present invention to provide a thread cutting device in a sewing machine which ensures that a lower thread retreating lever reliably engages a lower thread when the lower thread retreating lever is moved from a waiting position to an operative position and which permits the lower thread retreating lever to be small in size.

It is a further object of the present invention to provide a thread cutting device in a sewing machine which is operable to be automatically changed between a thread cutting mode for cutting both upper and lower threads and a thread cutting mode for cutting only the upper thread in response to a detected value of amount of movement of an embroidery frame after the thread cutting operation, so that a troublesome setting operation is eliminated.

It is a still further object of the present invention to provide a thread cutting device in a sewing machine which renders variations to conditions for automatically changing between two different thread cutting modes.

According to the present invention, there is provided a thread cutting device in a sewing machine, comprising:

a movable knife movable across a space between a throat plate and a shuttle positioned below said throat plate so as to perform a thread cutting operation;

a lower thread retreating lever movable from a waiting position to an operative position for retreating a lower thread taken out from the shuttle to a position out of a thread cutting orbit of the movable knife;

the thread cutting device being operable in either a thread cutting mode for cutting both an upper thread and a lower thread or a thread cutting mode for cutting only an upper thread by selectively positioning the lower thread retreating lever at either the waiting position or the operative position during the operation of the movable knife; and an actuator and an interlocking mechanism between the actuator and the lower thread retreating lever for driving the lower thread retreating lever, the actuator and the interlocking mechanism being positioned rearwardly of the shuttle.

With this construction, the actuator and the interlocking mechanism do not hinder the operation for changing a lower thread bobbin positioned within the shuttle to another one or the operation for oiling the shuttle. Further, a sufficient space can be secured for mounting a lower thread detecting device.

Preferably, the timing of movement of the lower thread retreating lever from the waiting position to the operative position is determined to correspond to the timing when the lower thread is tensioned by the upper thread which is pulled by a thread take-up lever. With this construction, when the lower thread retreating lever is moved from the waiting position to the operative position for the cutting operation of only the upper thread, the lower thread retreating lever can reliably engage the lower thread even if the lever is small since the lower thread is substantially fixed in position.

The thread cutting device may include a control device for controlling the actuator. Prior to the thread cutting operation, the control device detects a value of amount of movement of an embroidery frame after the thread cutting operation and compares the detected value with a predetermined reference value. When the detected value is less than the reference value, the control device drives the actuator for moving the lower thread retreating lever from the waiting position to the operative position. With the provision of the control device, the selection between two different thread cutting modes can be automatically performed in response to the detected value of amount of movement of the embroidery frame after the cutting operation. Therefore, it is not required for an operator to perform troublesome operations such as a setting operation of selection between two different cutting modes for each cutting point and an operation for inputting data of selection between two different cutting modes when he prepares embroidery data. Therefore, the preparing operation prior to starting for the sewing operation is simplified.

The reference value of amount of movement of the embroidery frame may be selectively determined, so that various conditions can be conveniently provided for automatically changing the cutting mode.

BRIEF DESCRIPTION OF THE DRAWINGS

FIG. 16 is a view similar to FIG. 15 but showing the thread cutting device when the solenoid is switched on.

DETAILED DESCRIPTION OF THE PREFERRED EMBODIMENT

A first and a second embodiment of the present invention will now be explained with reference to the accompanying drawings. Thread cutting devices according to these embodiments are those adapted to embroidery machines.

First Embodiment

Figure 1:
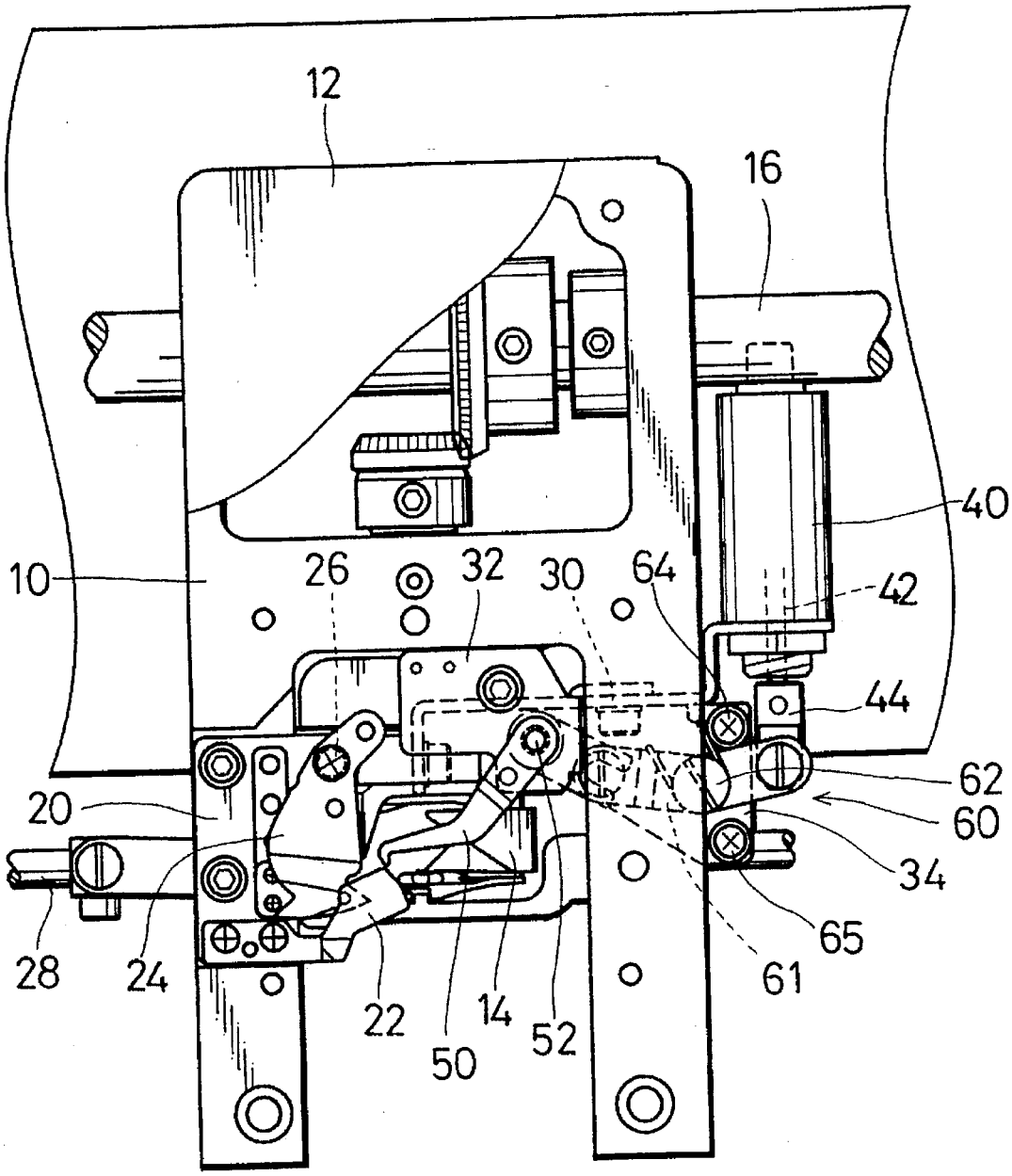
FIG. 1 is plan view of the essential parts of an embroidery machine incorporating a thread cutting device according to a first embodiment of the present invention.

Referring to FIG. 1, the essential parts of an embroidery machine are shown in plan view. These parts are those positioned below a sewing head (not shown) and include a thread cutting device according to the first embodiment of the present invention. A side view and a front view of FIG. 1 are shown in FIGS. 2 and 3, respectively.

Figure 2:
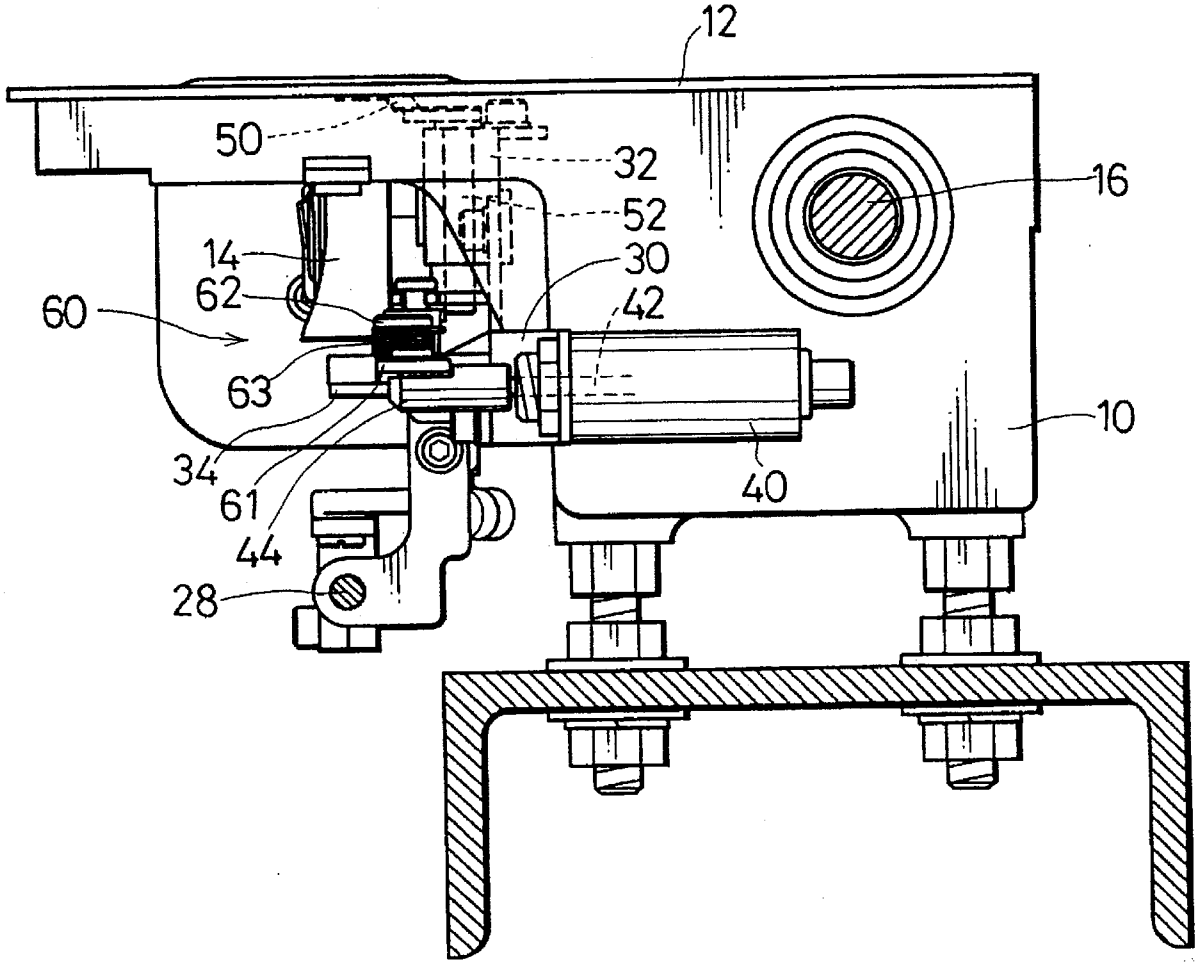
FIG. 2 is a side view of FIG. 1.
Figure 3:
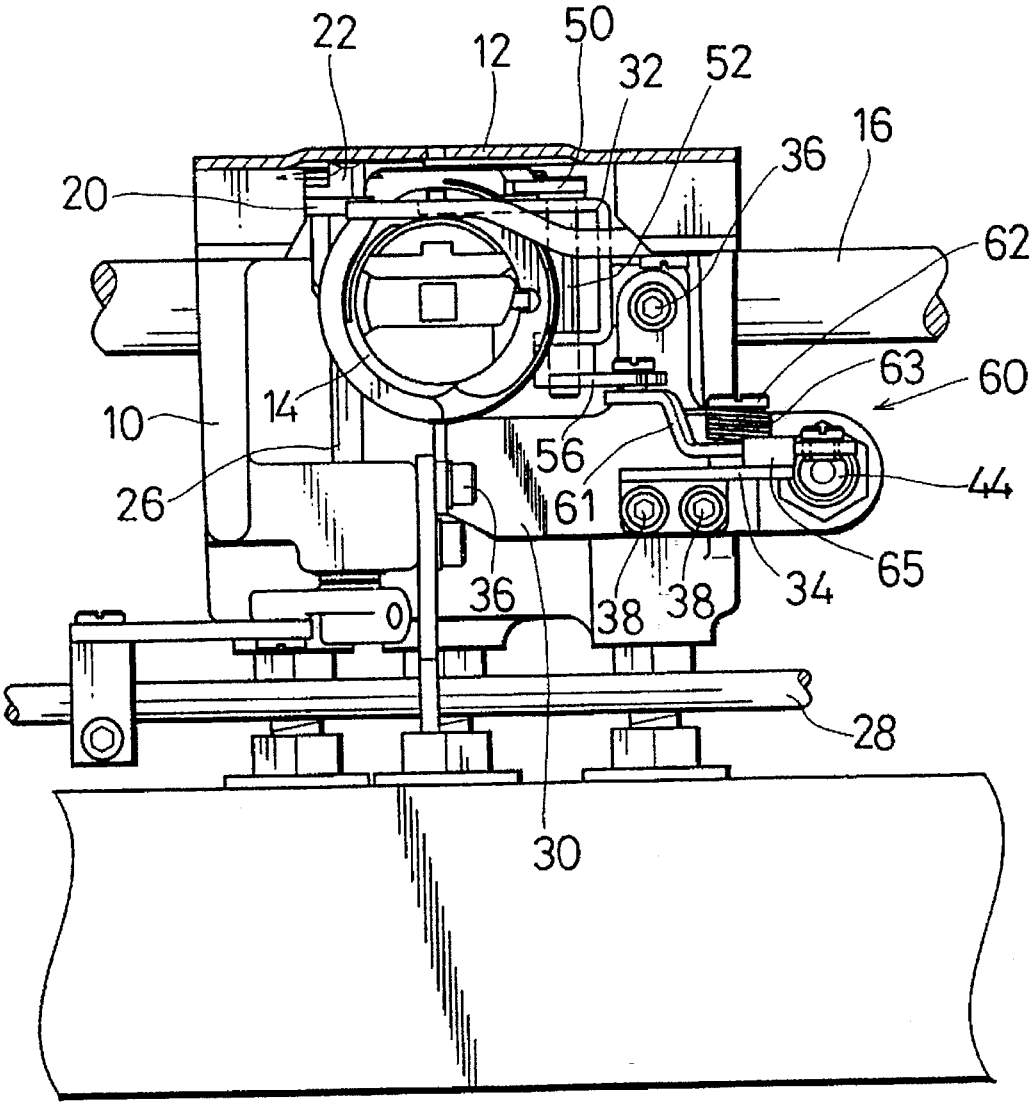
FIG. 3 is a front sectional view of FIG. 1.

As shown in FIGS. 1, 2 and 3, a throat plate 12 is secured to an upper surface of a shuttle base 10. A shuttle 14 is positioned below the throat plate 12. As is well known, the shuttle 14 has a bobbin case and a hook which is rotatably supported by the shuttle base 10 and which is rotatably driven relative to the bobbin case by a shuttle drive shaft 16.

As shown in FIGS. 1 and 3, a knife base 20 is secured to the shuttle base 10 in a position between the throat plate 12 and the shuttle 14. A fixed knife 22 is fixedly mounted on the knife base 20. A movable knife 24 is fixed to one end of a knife shaft 26 which is rotatably mounted on the knife base 20. The knife shaft 26 is interlocked with a knife drive shaft 28 which is positioned below the shuttle base 10 and which is reciprocally moved by a drive device (not shown), so that the movable knife 24 is reciprocally swung together with the knife shaft 26. By virtue of the swinging movement of the movable knife 24, the movable knife 24 cooperates with the fixed knife 22 to cut both upper and lower threads or to cut only the upper thread as will be explained later.

Figure 4:
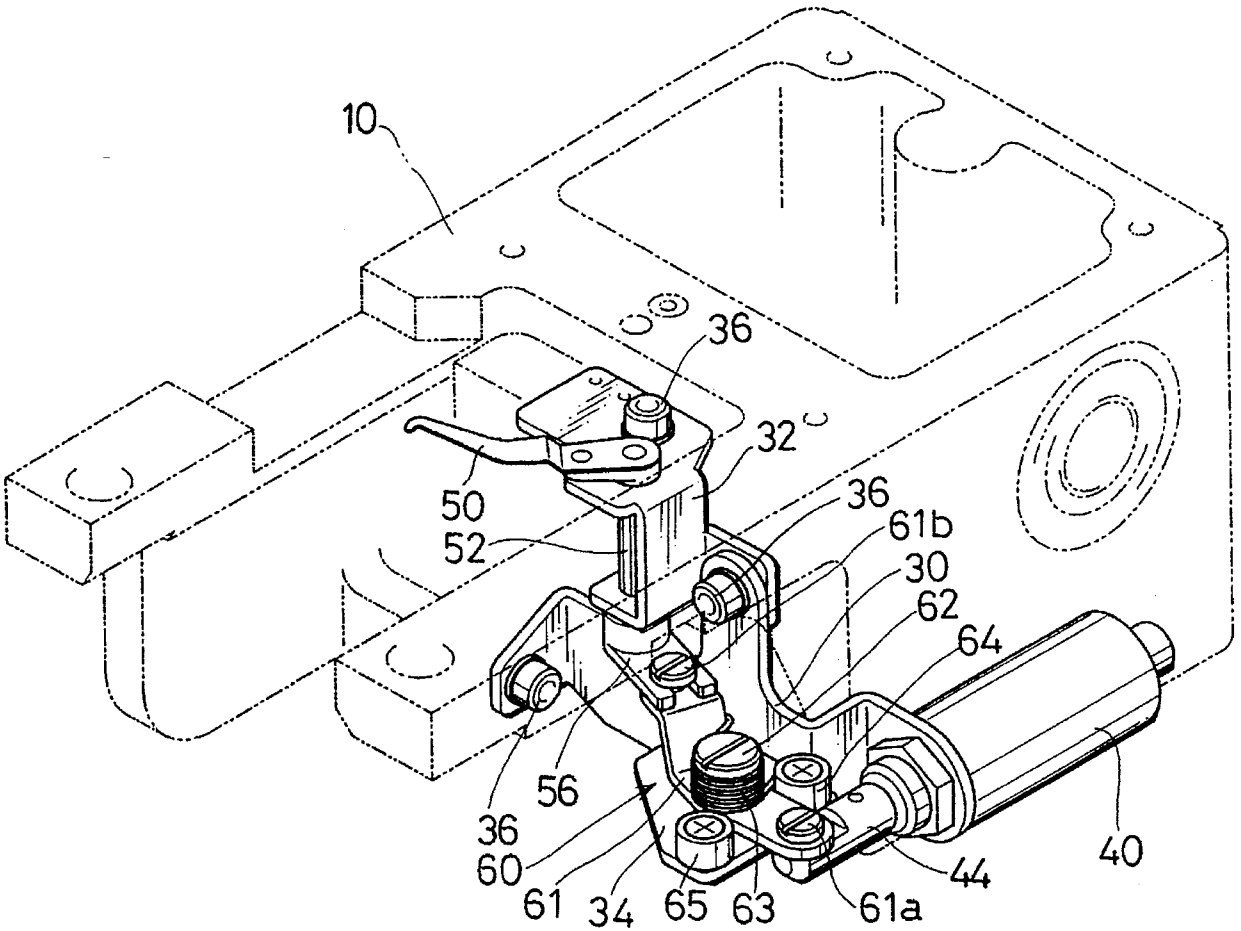
FIG. 4 is a perspective view of a lower thread retreating lever driving mechanism shown in FIG. 1.
Figure 5:
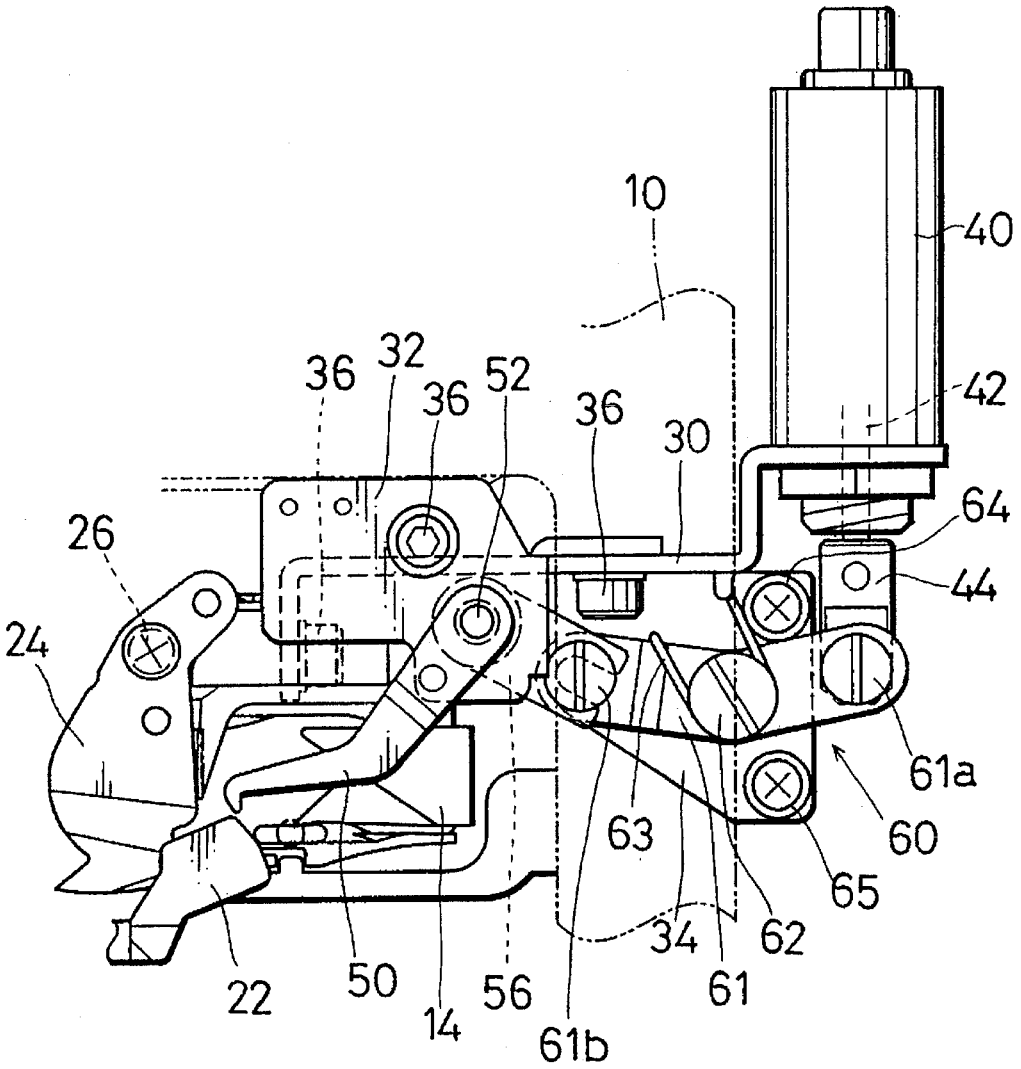
FIG. 5 is an enlarged plan view of the thread cutting device when a lower thread retreating lever is in a waiting position.

As shown in FIGS. 4 and 5, a first base 30 and a second base 32 are secured to the shuttle base 10 by means of a plurality of bolts 36. As shown in FIG. 3, a third base 34 is secured to the first base 30 by means of two bolts 38.

A solenoid 40 is fixed to the first base 30 and acts as an actuator for moving (swingably moving) a lower thread retreating lever 50. A lever shaft 32 is rotatably supported by the second base 32 and has an upper end to which a base end portion of the thread retreating lever 50 is secured. The solenoid 40 may be replaced by a different actuator such as an air cylinder and a motor.

An interlocking mechanism 60 will now be explained. The interlocking mechanism 60 transmits an actuating force of the solenoid 40 to the lower thread retreating lever 50.

A substantially middle portion of a swing lever 61 is pivotally supported by the third base 34 by means of a support shaft 62. The swing lever 61 has one end pivotally connected to a connecting member 44 by means of a connecting pin 61*a*. The connecting member 44 is mounted on one end of a plunger 42 of the solenoid 40. The swing lever 61 has the other end pivotally connected to an interlocking arm 56 by means of a connecting pin 61b. The interlocking arm 56 is secured to a lower end of the lever shaft 52. With this construction, when the plunger 42 is moved through an on/off control of the solenoid 40, the swing lever 61 and the interlocking arm 56 are swung to pivot the lower thread retreating lever 50 around the axis of the lever shaft 52.

The one end of the swing lever 61 connected to the connecting member 44 of the solenoid 40 includes an elongated hole so as to permit displacement of the connecting pin 61*a* along the swing lever 61 as the swing lever 61 is swung. On the other hand, the other end of the swing lever 61 connected to the interlocking arm 56 is recessed to permit displacement of the connecting pin 61*b* along the swing lever 61 as the swing lever 61 and the interlocking arm 56 are swung.

A pair of stoppers 64 and 65 are fixed to the third base 34 for limiting the swinging range of the swing lever 61. A torsion spring 63 is fitted on the support shaft 62 of the swing lever 61 and provides a resilient force to normally hold the swing lever 61 in a swinging position where the swing lever 61 abuts on the stopper 64 as shown in FIGS. 1 and 5.

With the swing lever 61 positioned to abut on the stopper 64, the lower thread retreating lever 50 is held in a waiting position as shown in FIGS. 1 and 5. When the solenoid 40 is switched on or exited, the plunger 42 extends outwardly from the solenoid 40, so that the swing lever 61 is swung against the biasing force of the torsion spring 63 until it abuts on the other stopper 65.

Figure 6:
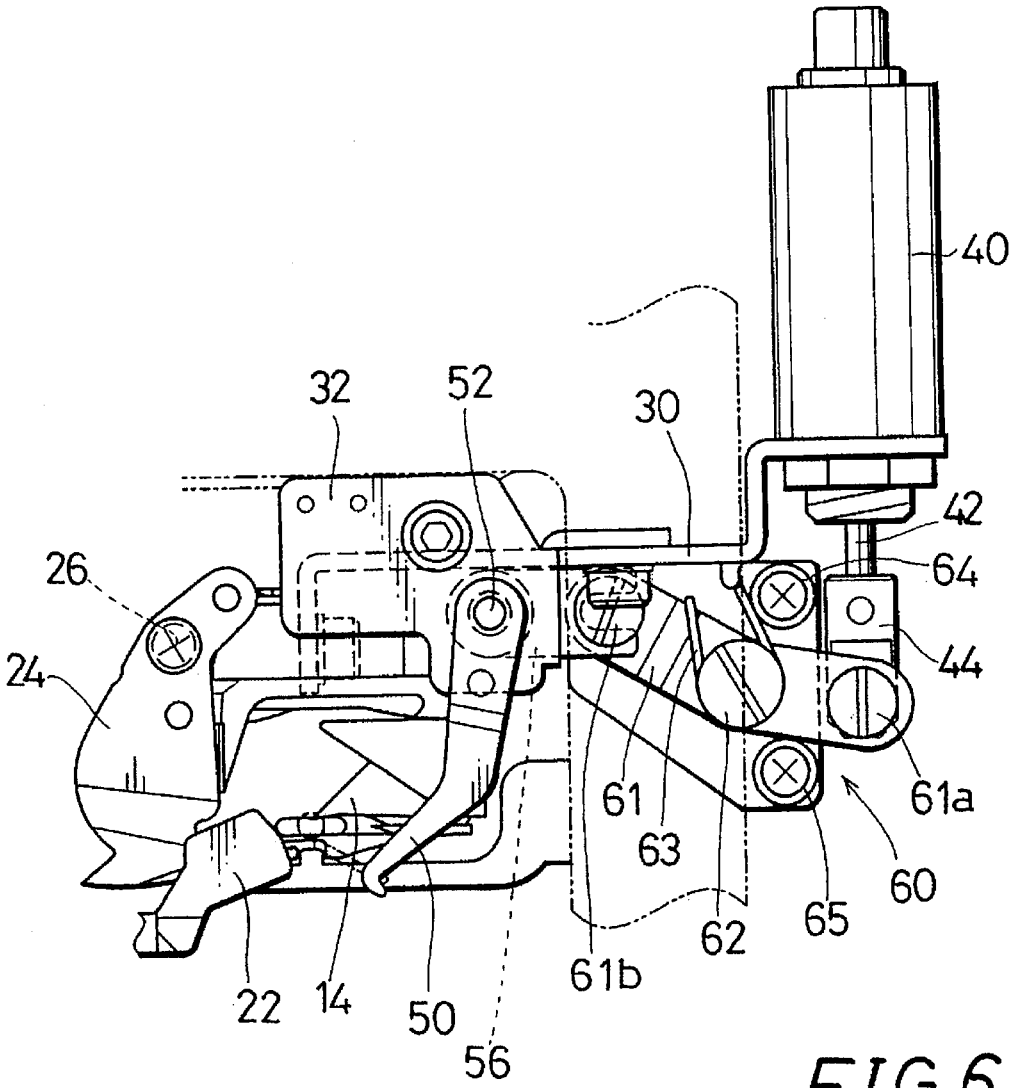
FIG. 6 is a view similar to FIG. 5 but showing the thread cutting device when the lower thread retreating lever is in an operative position.

FIG. 6 is a view similar to FIG. 5 but shows a state where the solenoid 40 is switched on. As will be seen from FIG. 6, as the swing lever 61 is swung, the lower thread retreating lever 50 is swung from the waiting position to an operative position shown in FIG. 6 and is then held in this position. When the solenoid 40 is switched off or is not exited, the interlocking mechanism 60 is returned to the state shown in FIGS. 1 and 5 by means of the resilient force of the torsion spring 63 applied to the swing lever 61, so that the lower thread retreating lever 50 is returned to the waiting position.

Figure 7:
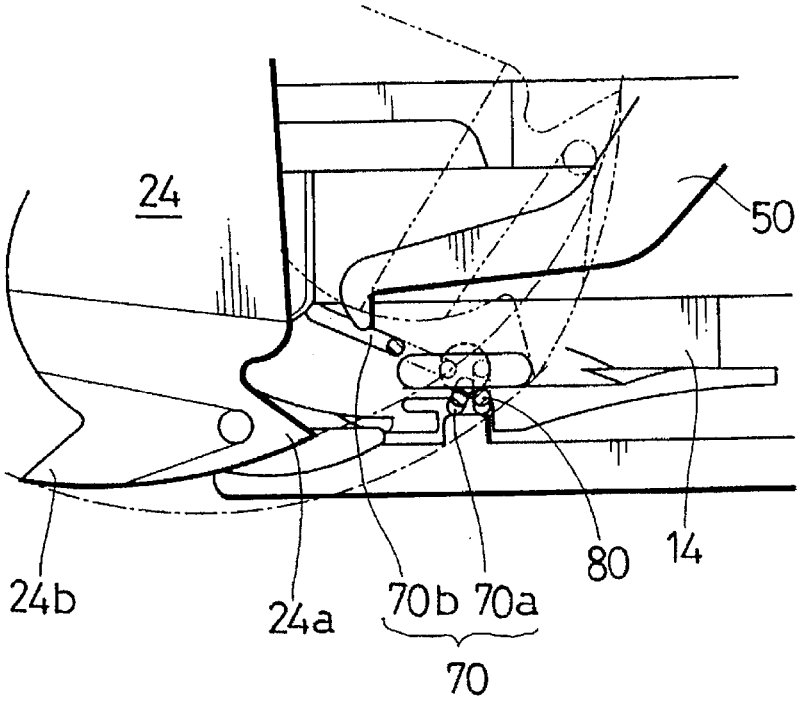
FIG. 7 is an enlarged plan view showing a swingable range of a movable knife with the thread cutting device in a cutting mode for cutting both upper and lower threads.
Figure 8:
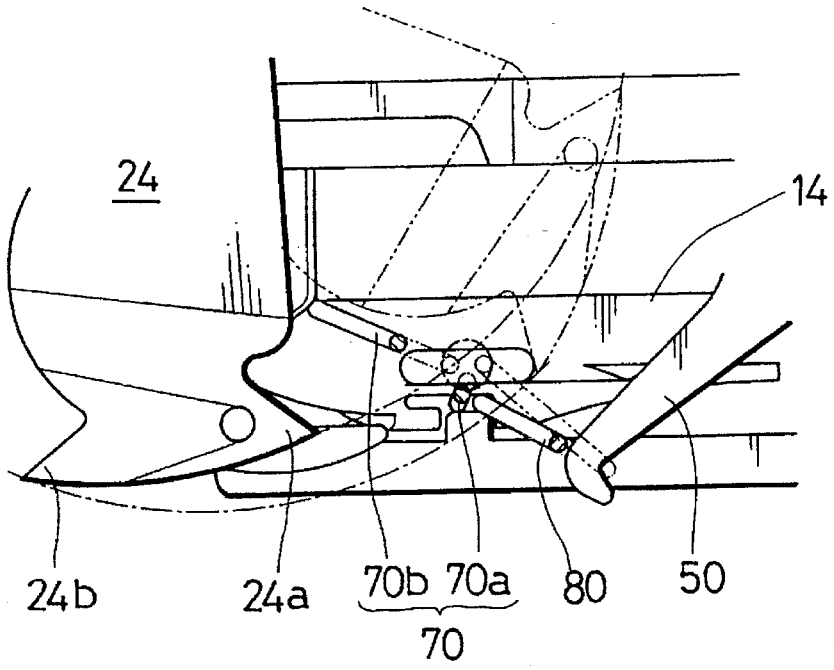
FIG. 8 is a view similar to FIG. 7 but showing the thread cutting device in a cutting mode for cutting only the upper thread.

As shown in FIGS. 7 and 8 which illustrate the swinging range of the movable knife 24 together with its associated members, the movable knife 24 is reciprocally swung between a position indicated by a solid line and a position indicated by a chain line in response to a reciprocal rotational movement of the knife drive shaft 28. As the movable knife 24 is swung from the solid line position to the chain line position based on a predetermined thread cutting signal, a pointed end 24a of the movable knife 24 moves between an upper fabric thread 70a of an upper thread 70 and an upper needle thread 70b thereof which are connected to a work fabric and a sewing needle, respectively, so that the upper fabric thread 70*a* and the upper needle thread 70*b* are separated from each other. The movable knife 24 is then swung to return from the chain line position to the solid line position, so that both the upper fabric thread 70*a* and a lower thread 80 are engaged (see FIG. 7) or only the upper fabric thread 70*a* is engaged (see FIG. 8) by the movable knife 24 to be conveyed to a position where the movable knife 24 cooperates with the fixed knife 22 for cutting the threads or thread. Thus, an area between an orbit of the pointed end 24*a* and an orbit of a pointed end 24*b* positioned on the opposite side of the pointed end 24*a* correspond to a thread cutting orbit of the movable knife 24.

It is to be noted that the positions of the upper fabric thread 70*a*, the upper needle thread 70*b* and the lower thread 80 illustrated in FIGS. 7 and 8 are those at a height equal to the height of the movable knife 24.

As described above, with the thread cutting device of this embodiment, a thread separating operation is performed when the movable knife 24 is swung in a counterclockwise direction in FIGS. 7 and 8 based on the thread cutting signal, and the thread cutting operation is performed when the movable knife 24 is thereafter swung in an opposite direction or a clockwise direction. The present invention may be also applied to a thread cutting device where a thread separating operation is performed when a movable knife is swung in a clockwise direction in plan view, and where a thread cutting operation is performed when the movable knife is thereafter swung in a counterclockwise direction.

The operation of the solenoid 40 is controlled by a computer (not shown) based on embroidery data inputted to the computer by means of a punched tape or a key board. Based on the embroidery data, the computer also controls the movement of an embroidery frame and other components related to the embroidery operation.

The computer outputs a thread cutting signal at timings corresponding to stop codes and an ending code set in the embroidery data. The stop codes are set at each point corresponding to an ending of each pattern part of an embroidery pattern or are set at each point where it is necessary to temporarily stop an embroidery operation for changing the upper thread 70 to another one having a different color. The ending code is set at a point where the embroidery operation is completed.

When the thread cutting operation is performed based on the stop codes, it is necessary to select one of two cutting modes in response to the distance between the end of one of the embroidery pattern part and the beginning of the next embroidery pattern part or the amount of movement of an embroidery frame (not shown) therebetween. As described above, one of the two cutting modes is adapted for cutting both the upper fabric thread 70*a* and the lower thread 80, and the other is adapted for cutting only the upper fabric thread 70*a*. These modes are hereinafter called "upper and lower thread cutting mode" and "upper thread cutting mode", respectively. When the thread cutting operation is performed based on the ending code, the operation is always performed in the upper and lower thread cutting mode.

The operations in the above cutting modes will now be explained.

In order to operate in the upper and lower thread cutting mode when the sewing position on the work fabric is substantially changed or when the embroidery operation has been completed, the solenoid 40 is held off to maintain the lower thread retreating lever 50 at the waiting position. With this condition, based on the thread cutting signal, the movable knife 24 is reciprocally swung between the solid line position and the chain line position as shown in FIG. 7, so that both the upper fabric thread 70*a* and the lower thread 80 are cut.

On the other hand, in order to operate in the upper thread cutting mode, the solenoid 40 is switched on, so that the lower thread retreating lever 50 is swung from the waiting position shown in FIG. 5 to the operative position shown in FIG. 6. As the lower thread retreating lever 50 is thus swung, the lower thread 80 is engaged by an end portion of the lower thread retreating lever 50 and is retreated from the thread cutting orbit of the movable knife 24 as shown in FIG. 8. With this condition, the movable knife 24 is reciprocally swung between the solid line position and the chain line position as shown in FIG. 8, so that only the upper fabric thread 70*a* is cut.

Figure 9:
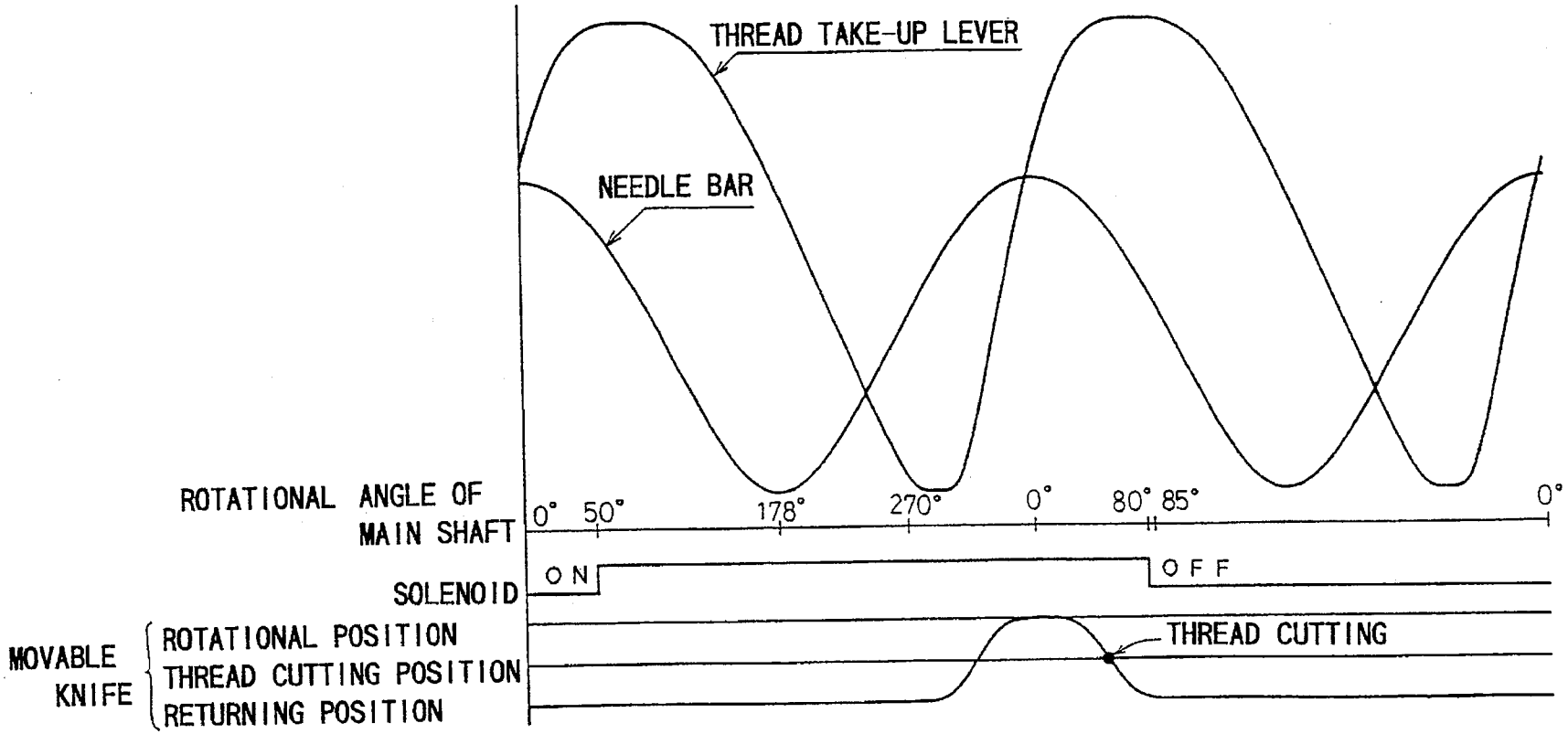
FIG. 9 is a timing chart showing timings of on/off control of a solenoid of the lower thread retreating lever with respect to operational timings of various elements of the embroidery machine including a thread take-up lever and a needle bar.
Figure 10:
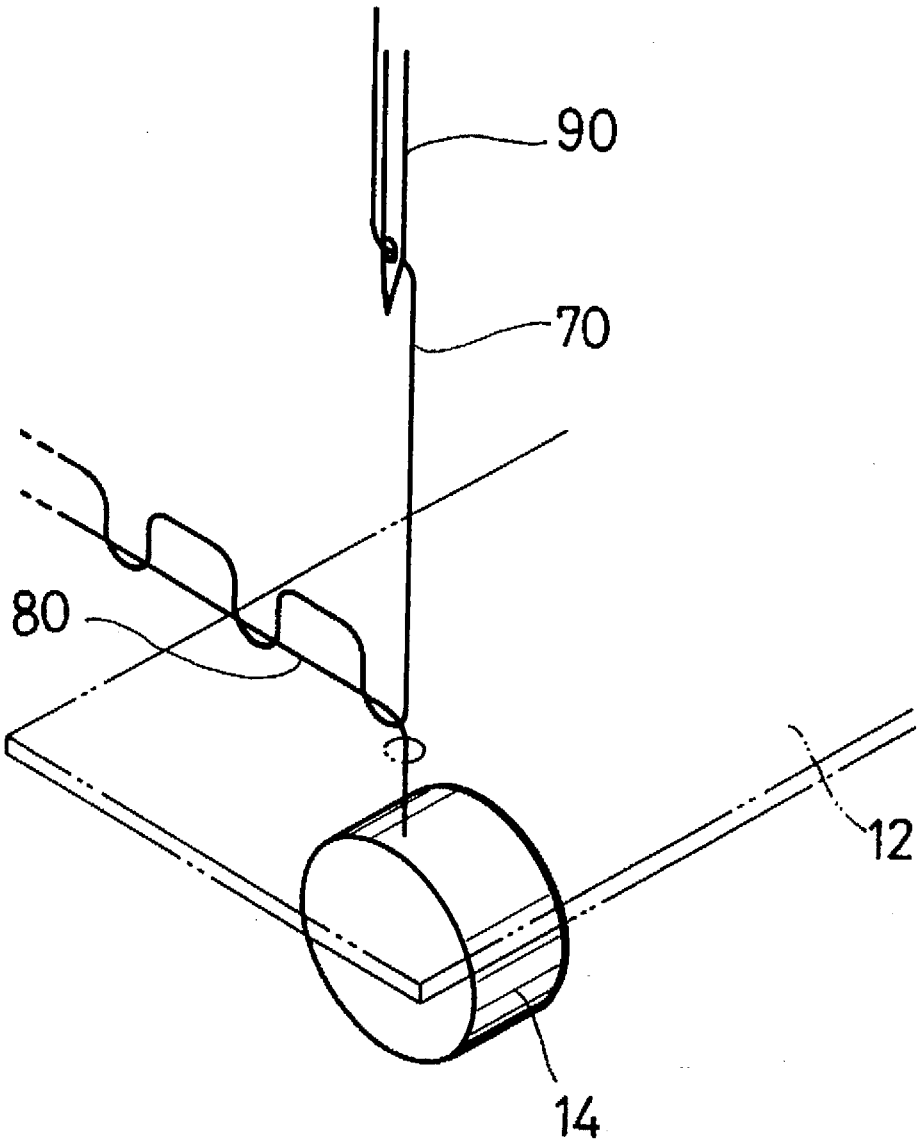
FIG. 10 is a schematic perspective view showing the upper and lower threads when a sewing needle is moved upwardly to a position above a throat plate.
Figure 11:
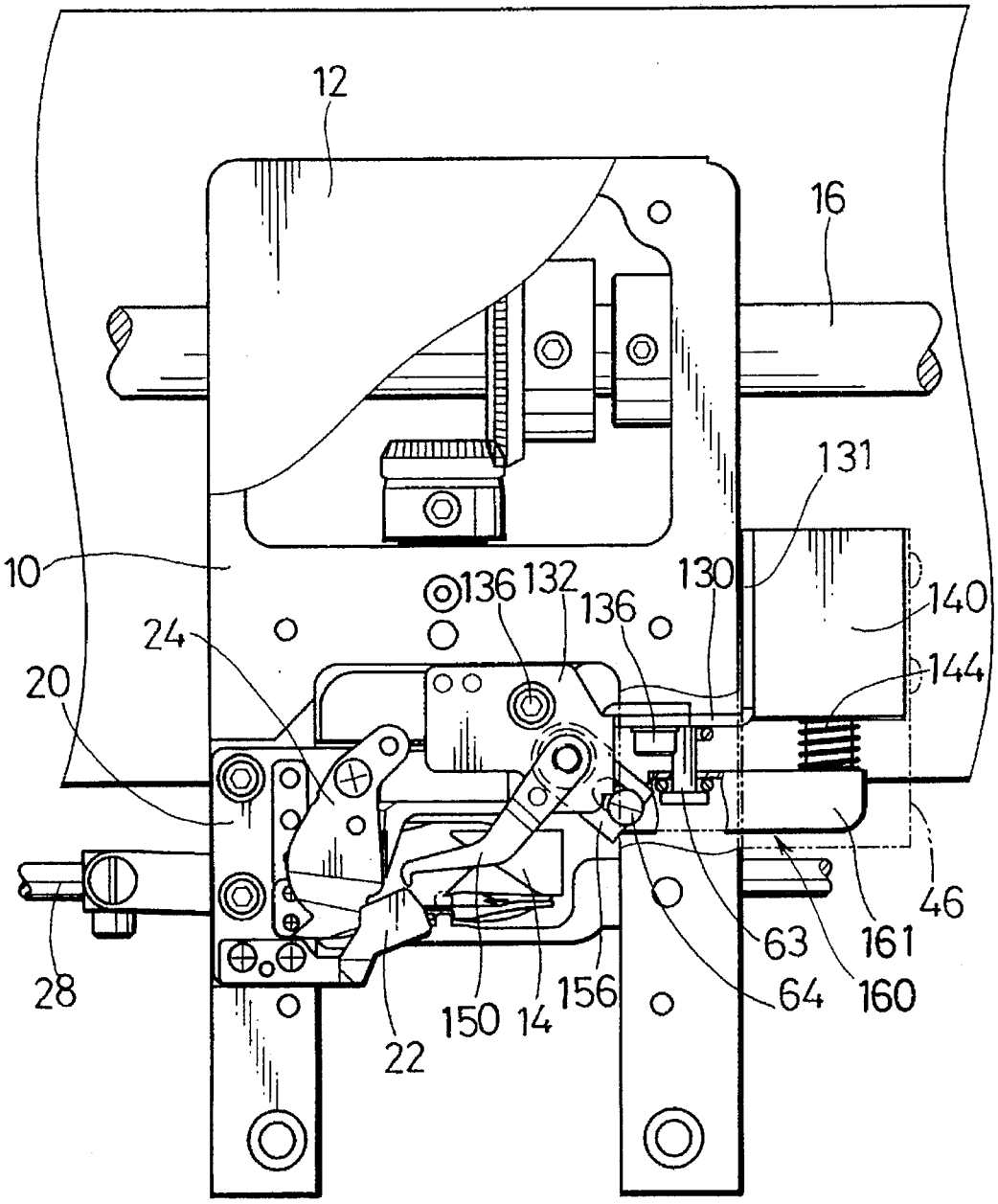
FIG. 11 is a view similar to FIG. 1 but showing a thread cutting device according to a second embodiment of the present invention.
Figure 12:
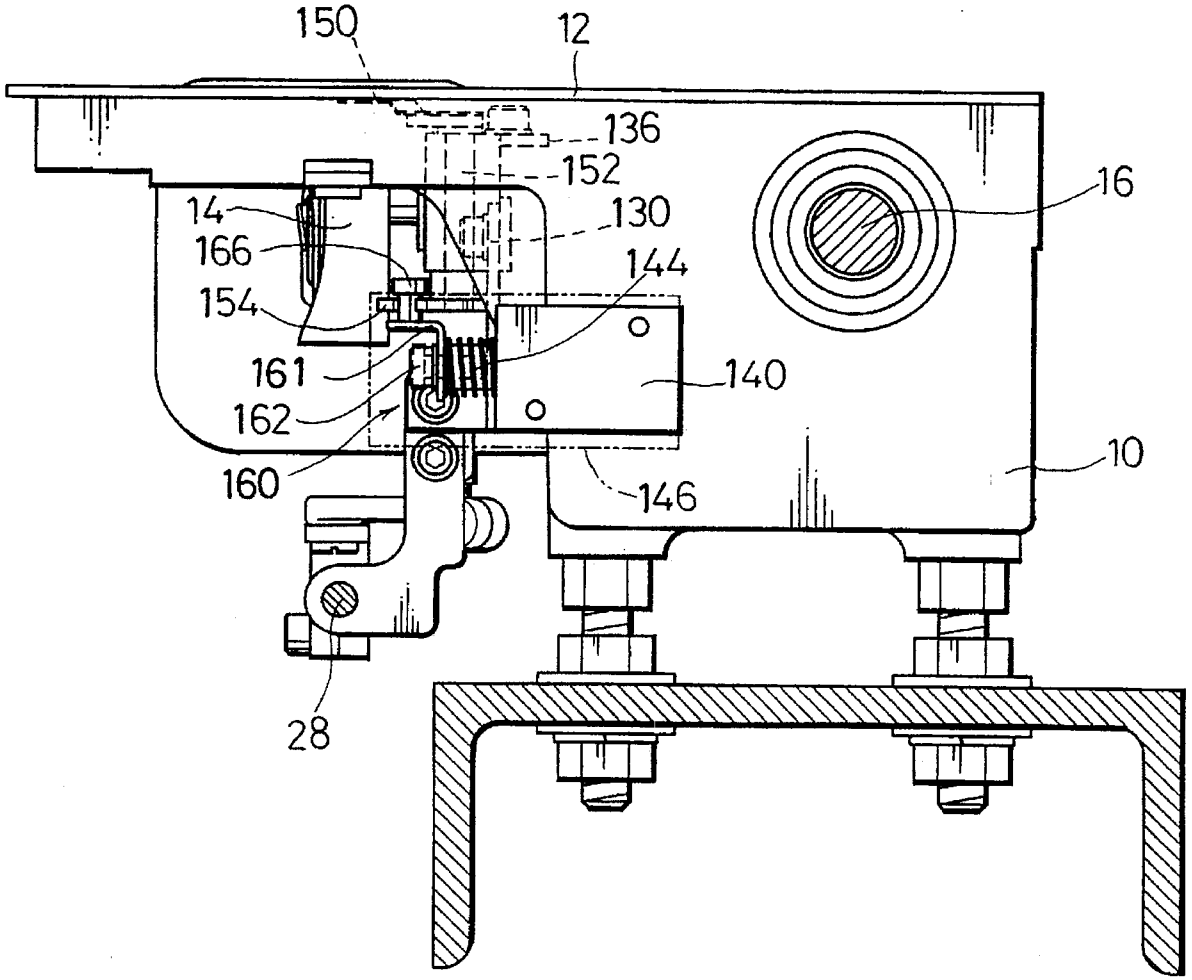
FIG. 12 is a side view of FIG. 11.
Figure 13:
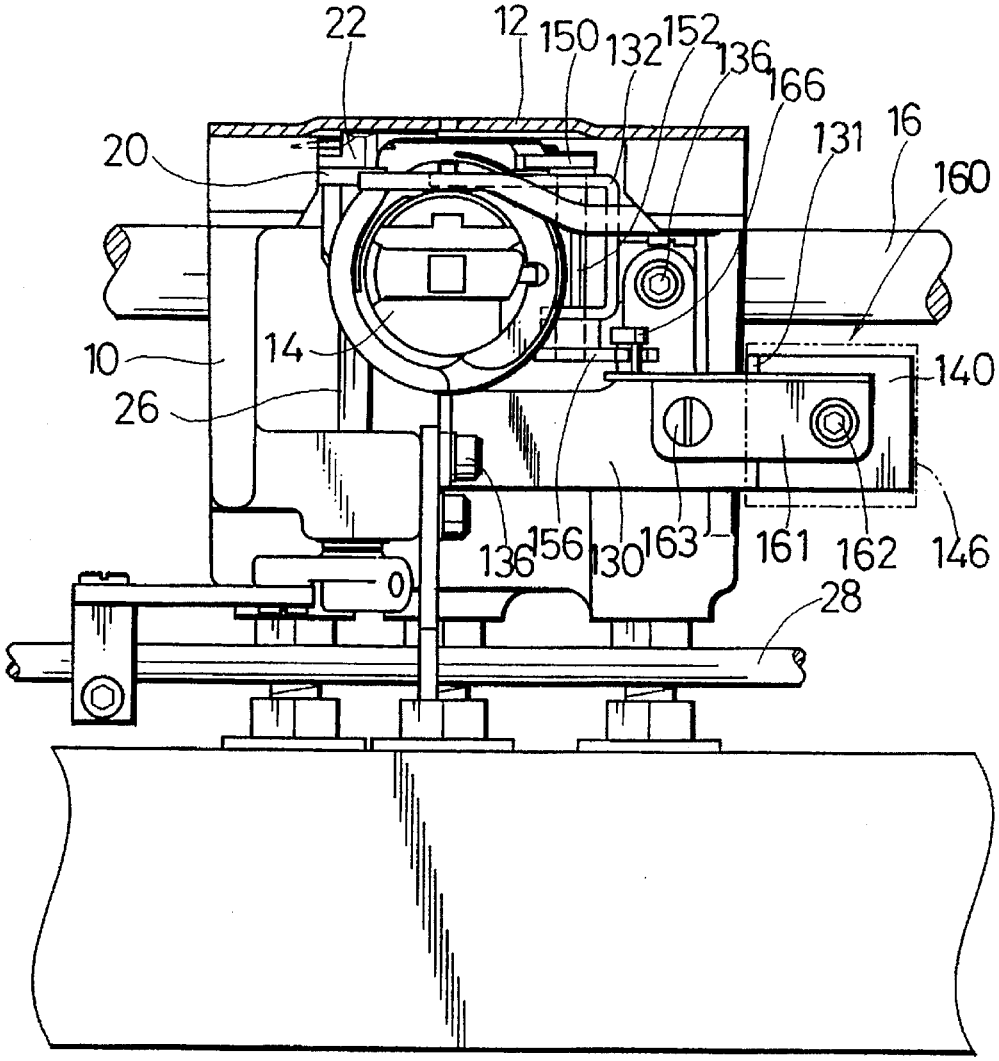
FIG. 13 is a front sectional view of FIG. 11.

Timings of on/off operation of the solenoid 40 is shown in FIG. 9 in connection with various operational modes of a thread take-up lever (not shown) and a needle bar (not shown) and in connection with the swinging position of the movable knife 24. As will be seen from FIG. 9, the timing of switching on the solenoid 40 for moving the lower thread retreating lever 50 to the operative position is determined to correspond to a timing when the thread take-up lever is positioned nearly at its upper dead center (when a rotational angle of a main shaft of the embroidery machine is 90°).

At this timing, a sewing needle 90 mounted on a lower end of the needle bar is lifted above the throat plate 12, and the upper thread 70 is pulled upwardly by the thread take-up lever which is moving upwardly. Thus, no upper thread 70 exists below the throat plate 12. Therefore, the lower thread retreating lever 50 reliably retreats only the lower thread 80 from the thread cutting orbit of the movable knife 24. Additionally, the upper thread 70 pulled by the thread take-up lever in turn pulls the lower thread 80, so that the lower thread 80 extends vertically reliably at a fixed position. The lower thread 80 can therefore be reliably engaged by the lower thread retreating lever 50.

Here, a timing for moving the movable knife 24 based on the thread cutting signal to separate the upper fabric thread 70*a* and the upper needle thread 70*b* from each other corresponds to a timing when the upper fabric thread 70*a* and the upper needle thread 70*b* are separated from each other to some extent at a position above the shuttle 14 through rotation of the hook of the shuttle 14 during the upward movement of the needle bar (see FIG. 9). The movable knife 24 is then returned to perform the thread cutting operation. The solenoid 40 is switched off at a timing immediately before the movable knife 24 reaches its original position, so that the thread retreating lever 50 returns from the operative position to the waiting position.

Second Embodiment

The second embodiment will now be explained with reference to FIGS. 11 to 17. The second embodiment is a modification of the first embodiment, and therefore, parts that are the same as those in the first embodiment are given like reference numerals and their description will not be repeated.

As shown in FIGS. 11 to 15, an actuator bracket 130 and a lever bracket 132 are secured to the shuttle base 10 by means of a plurality of bolts 136. The actuator bracket 130 has a mounting portion 131 bent rearwardly along one lateral side of the shuttle base 10. A solenoid 140 is fixed to the mounting portion 131 and acts as an actuator for moving (swingably moving) a lower thread retreating lever 150.

Figure 14:
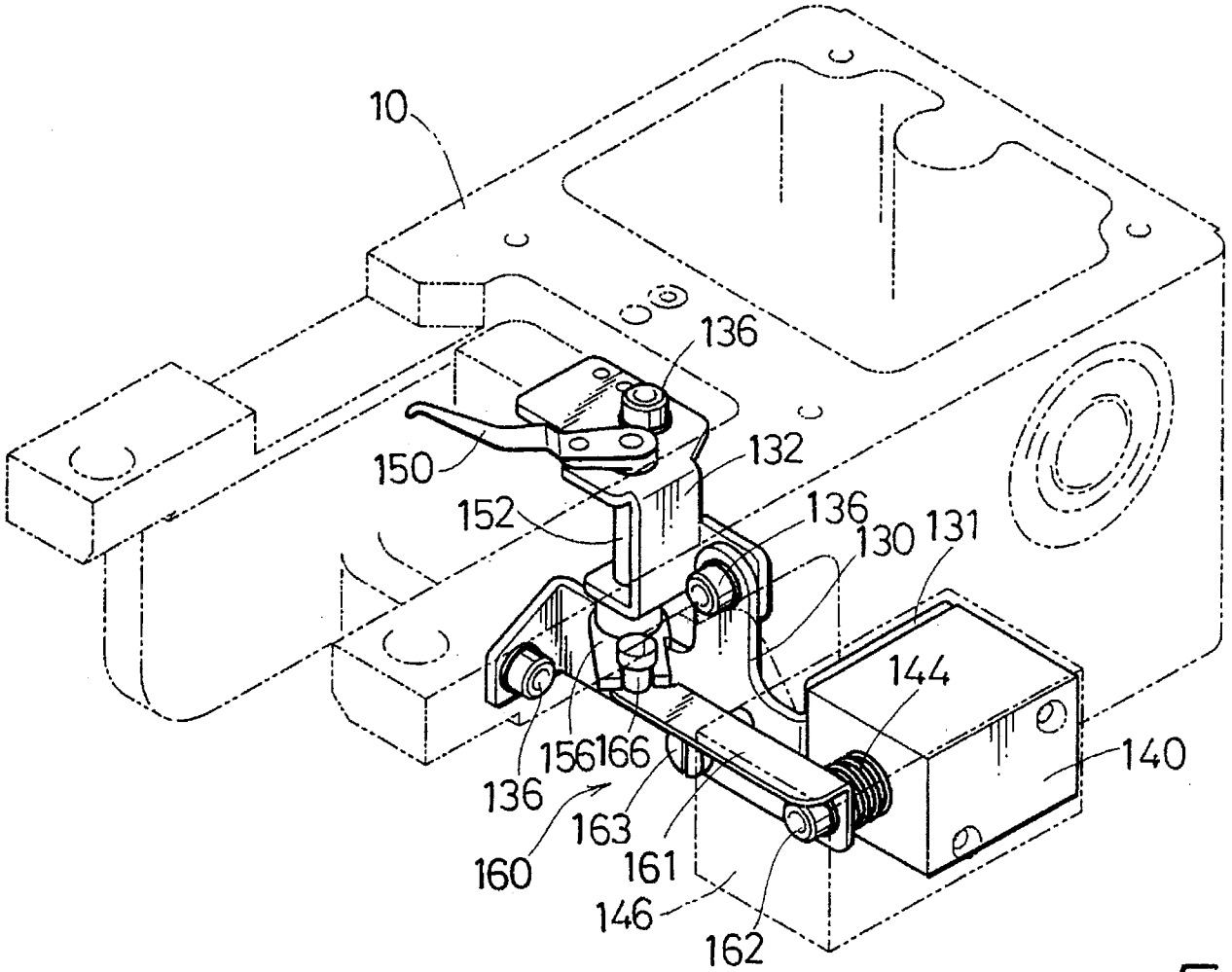
FIG. 14 is a perspective view of a lower thread retreating lever driving mechanism shown in FIG. 11.
Figure 15:
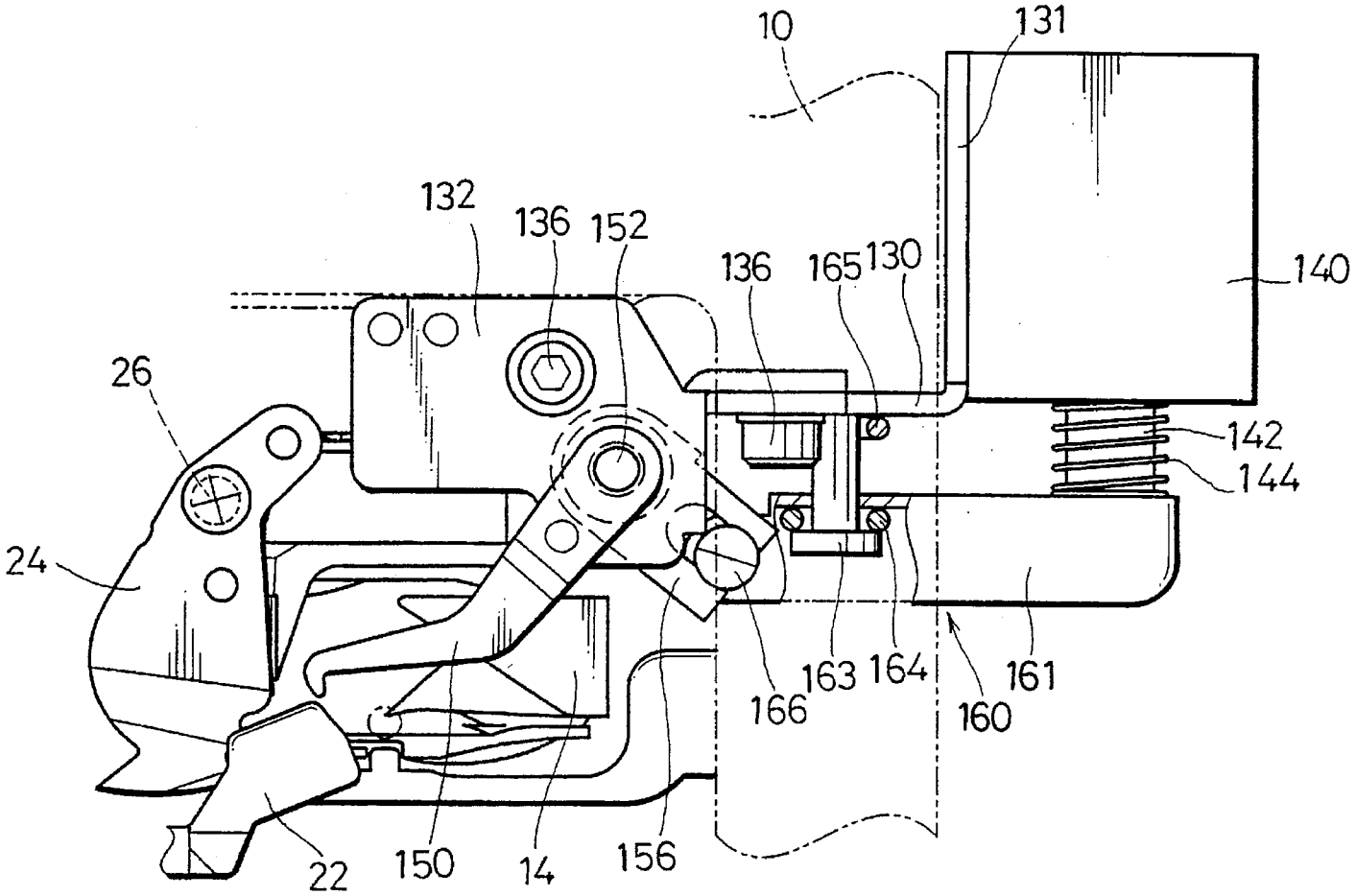
FIG. 15 is an enlarged plan view of the thread cutting device when a solenoid for driving the lower thread retreating lever is held off.

An interlocking mechanism 160 for transmitting the actuating force of the solenoid 140 to the lower thread retreating lever 150 will now be explained. As shown in FIGS. 14 and 15, a headed pin 163 is fixed to the front surface of the actuator bracket 130. A drive lever 161 is supported by the headed pin 163 such that the drive lever 161 is movable forwardly and rearwardly along the axis of the headed pin 163. Damper rings 164 and 165 are fitted on the headed pin 163 at positions between the head of the headed pin 163 and the drive lever 161 and between the front surface of the actuator bracket 130 and the drive lever 161, respectively.

The drive lever 161 has one end (right side end) connected to the forward end of a plunger 142 of the solenoid 140 by means of a fixing screw 162. A connecting pin 166 is fixed to the other end of the drive lever 161 and extends upwardly therefrom.

A spring 144 is interposed between the front surface of the solenoid 140 and the drive lever 161 and biases the plunger 142 as well as the drive lever 161 in a forward direction. The biasing force of the spring 144 is applied from the drive lever 161 to the head of the headed pin 163 by means of the damper ring 164 as shown in FIG. 15.

The whole of the solenoid 140 and the plunger 142 as well as a part of the drive lever 161 is positioned within a cover 146 as indicated by chain lines in FIGS. 11 to 14.

A vertical lever shaft 152 is rotatably supported by the lever bracket 132. The lower thread retreating lever 150 has a base end secured to the upper end of the lever shaft 152 at a position above the lever bracket 132. An interlocking arm 156 has a base end secured to the lower end of the lever shaft 152 at a position below the lever bracket 132. The other end of the interlocking arm 156 has a fork like configuration and receives a connecting pin 166 of the drive lever 161 such that the connecting pin 166 is pivotable relative to the interlocking arm 156.

When the drive lever 161 is positioned forwardly by the biasing force of the spring 144, the lower thread retreating lever 150 is held in a waiting position shown in FIG. 15. When the solenoid 140 is switched on or exited, the drive lever 161 is moved rearwardly by the plunger 142 against the biasing force of the spring 144 until the drive lever 161 abuts on the front surface of the actuator bracket 130 by means of the damper ring 165.

Figure 16:
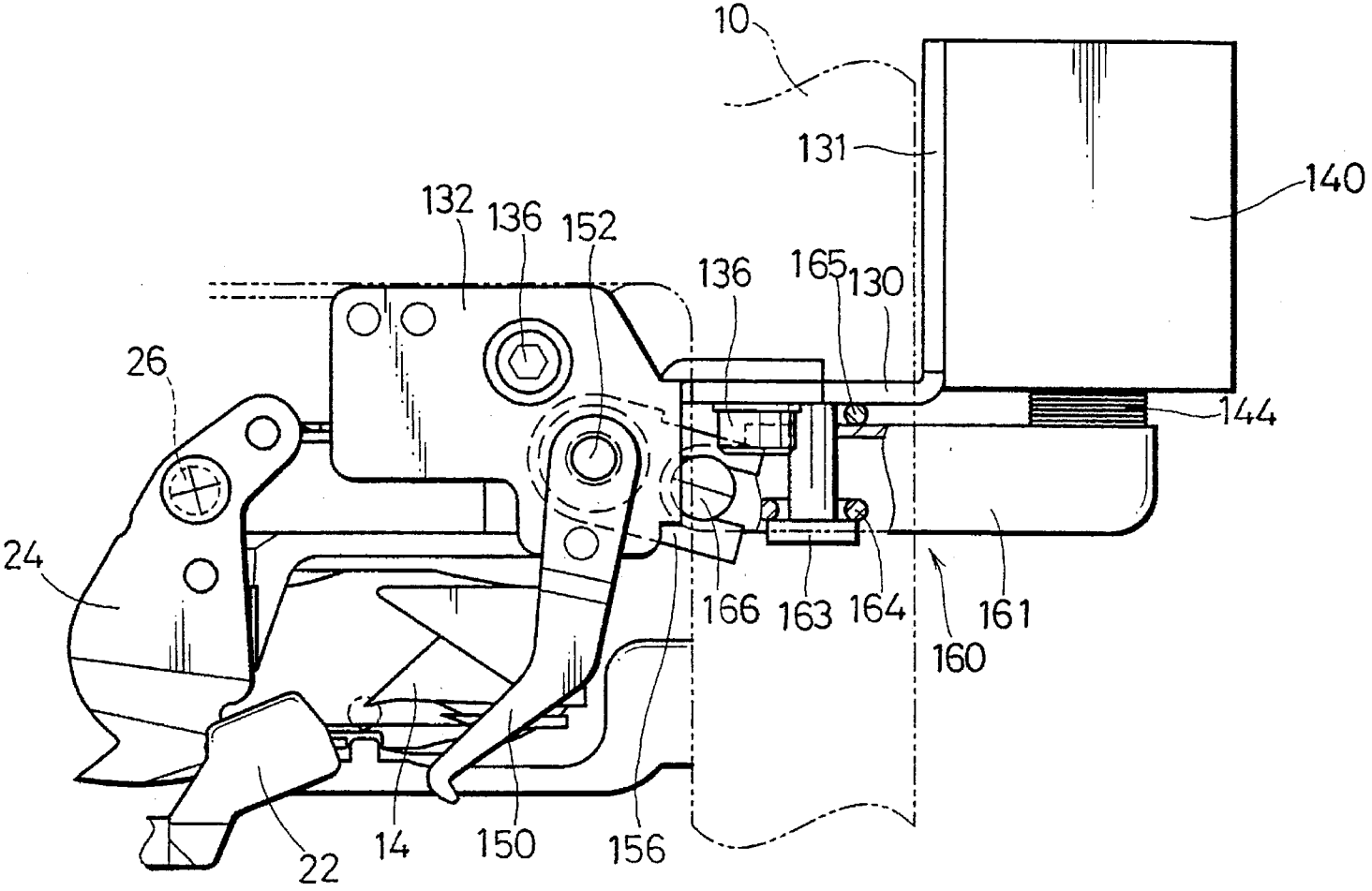

The state after the solenoid 140 has been switched on is shown in FIG. 16 which corresponds to FIG. 15. As will be seen from FIG. 16, when the drive lever 161 is moved rearwardly, the lower thread retreating lever 150 is swung from the waiting position to an operative position shown in FIG. 16 and is then held in this position. When the solenoid 14 is switched off or is not exited, the drive lever 161 returns forwardly by the biasing force of the spring 144, so that the lower thread retreating lever 150 returns to the waiting position.

Similar to the first embodiment, the operation of the solenoid 140 is controlled by a computer (not shown) based on embroidery data inputted to the computer by means of a punched tape or a key board. Based on the embroidery data, the computer also controls the movement of an embroidery frame and other components related to the embroidery operation.

With this embodiment, prior to the thread cutting operation, the computer detects the amount of movement of the embroidery frame from each ending point of the pattern parts of the embroidery pattern to the beginning point of its next pattern part. As described above, the stop code are set at each ending point of the pattern parts. The computer then compare the detected value with a predetermined reference value. If the detected value is greater than the reference value, the solenoid 140 is held off, so that the upper and lower thread cutting mode is selected. If the detected value is equal to or less than the reference value, the solenoid 140 is switched on, so that the upper thread cutting mode is selected.

The detected value is obtained from the embroidery data through reading therefrom the amount of movement of the embroidery frame after the thread cutting operation to be performed, prior to the thread cutting operation. The detected value may be calculated as a combined value of the amount with respect to X axis and the amount with respect to Y axis. Here, X axis and Y axis are those within a plane of an embroidery pattern and are perpendicular to each other. In order to simplify the process, between the amount with respect to X axis and that with respect to Y axis, the amount having a greater absolute value is incorporated as the detected value.

The reference value may be selectively determined in response to the sewing condition or the like. In this 3embodiment, four reference values of "5 mm", "10 mm", "15 mm" and "20 mm" are selectively used.

Figure 17:
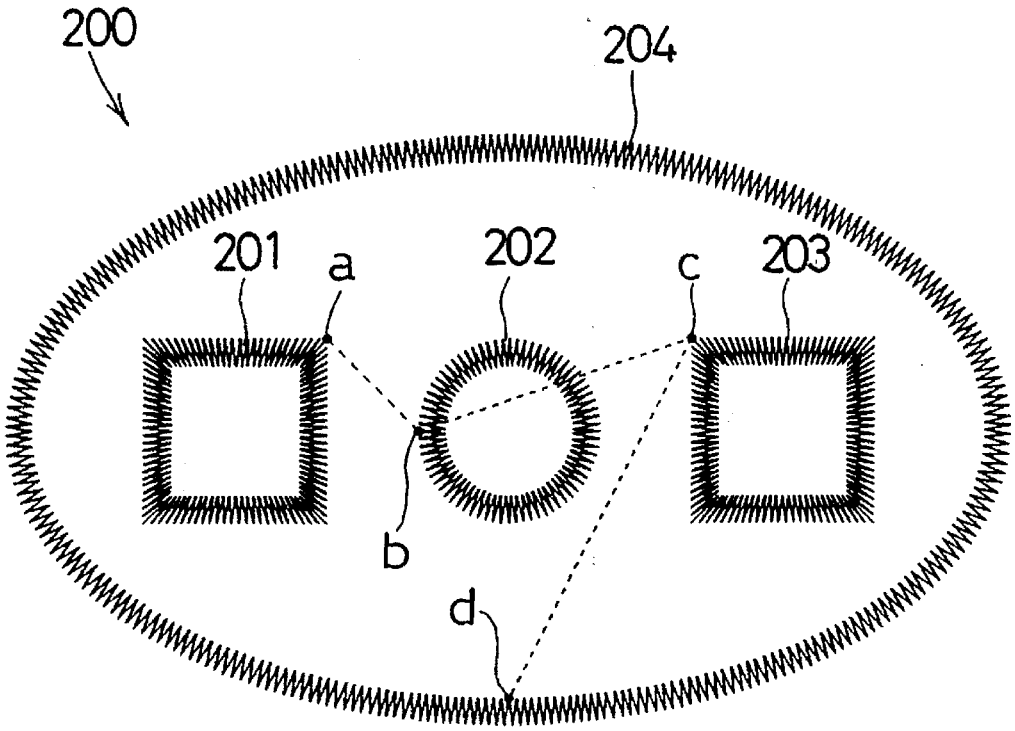
FIG. 17 is an explanatory view of an example of an embroidery pattern to be sewn.

A typical embroidery pattern 200 is shown in FIG. 17. The change between two different cutting modes will be explained with reference to FIG. 17.

The embroidery pattern 200 includes four different pattern parts 201, 202, 203 and 204. Points a, b and c represent the sewing starting points or the ending points of the pattern parts 201, 202 and 203, respectively. The stop code is set at each of the points a, b and c. A point d represents the sewing starting point or the ending point of the pattern part 204 itself and also represents the ending point of the whole embroidery pattern 200. The ending code is therefore set at this point d.

For example, the reference value is determined as "10 mm", and the distance of movement from the point a to the point b, the distance from the point b to the point c and the distance from the point c to the point d are determined as follows:

$a \rightarrow b$: $X=+6$ mm, $Y=-8$ mm $b \rightarrow c$: $X=+30$ mm, $Y=+8$ mm $c \rightarrow d$: $X=-20$ mm, $Y=-40$ mm The selection between two different cutting modes based on the stop codes are performed as follows:

(1) For the cutting operation before "a→b", since the detected value is 8 mm which is less than the reference value of 10 mm, the solenoid 140 is switched on, so that the upper thread cutting mode is selected.

(2) For the cutting operation before "b→c", since the detected value is 30 mm which is greater than the reference value, the solenoid 140 is held off, so that the upper and lower thread cutting mode is selected.

(3) For the cutting operation before "c→d", since the detected value is 40 mm which is greater than the reference value, the solenoid 140 is held off, so that the upper and lower thread cutting mode is selected.

The condition of selection between two different cutting modes can be varied by appropriately determining the reference value. For example, when the reference value is determined as "5 mm", the detected value for "a→b" is greater than the reference value, so that the upper and lower thread cutting mode is selected.

While the invention has been described with reference to preferred embodiments, it is to be understood that modifications or variation may be easily made without departing from the spirit of this invention which is defined by the appended claims.

What is claimed is:

1. A thread cutting device in a sewing machine, comprising:

a movable knife movable across a space between a throat plate and a shuttle positioned below said throat plate so as to perform a thread cutting operation;

a lower thread retreating lever movable from a waiting position to an operative position for retreating a lower thread taken out from said shuttle to a position out of a thread cutting orbit of said movable knife;

the thread cutting device being operable in either a thread cutting mode for cutting both an upper thread and a lower thread or a thread cutting mode for cutting only an upper thread by selectively positioning said lower thread retreating lever at either said waiting position or said operative position during the operation of said movable knife; and an actuator and an interlocking mechanism between said actuator and said lower thread retreating lever for driving said lower thread retreating lever, said actuator and said interlocking mechanism being positioned on the side of the shuttle which is opposite to the side for mounting a shuttle bobbin on said shuttle.

2. The thread cutting device as defined in claim 1 wherein said actuator is a solenoid having a plunger which extends outwardly from said solenoid when said solenoid is activated.

3. The thread cutting device as defined in claim 1 wherein said actuator is a solenoid having a plunger which retracts into said solenoid when said solenoid is activated.

4. The thread cutting device as defined in claim 1 wherein a timing of movement of said lower thread retreating lever from said waiting position to said operative position is determined to correspond to a timing when the lower thread is tensioned by the upper thread through a pulling operation of a thread take-up lever.

5. The thread cutting device as defined in claim 1 further including control means for controlling said actuator, said control means being operable such that:

prior to the cutting operation, said control means detects a value corresponding to an amount of movement of an embroidery frame after the thread cutting operation;

said control means compares the detected value with a predetermined reference value; and said control device drives said actuator for moving the lower thread retreating lever from said waiting position to said operative position when the detected value is less than said reference value.

6. The thread cutting device as defined in claim 5, wherein said detected value is obtained as a combined value of an amount of movement of said embroidery frame with respect to perpendicular X and Y axes.

7. The thread cutting device as defined in claim 5 wherein a greater value between absolute values of an amount of movement of said embroidery frame with respect to said X axis and Y axis is determined as said detected value.

8. The thread cutting device as defined in claim 5 wherein said reference value is selectively determined.

9. The thread cutting device as defined in claim 1 wherein:

said lower thread retreating lever is pivotable between said waiting position and said operative position and has a pivotal axis positioned rearwardly of said shuttle;

said actuator is disposed laterally rearwardly of said shuttle; and said interlocking mechanism is a link mechanism connecting said actuator and said lower thread retreating lever to each other.

10. The thread cutting device as defined in claim 9 wherein:

said actuator has a longitudinal axis and is disposed in parallel to a forward and a rearward direction of said shuttle;

said actuator has a plunger on a front side thereof, said plunger being movable to advance from and retreat into said plunger in a longitudinal direction of said plunger; and said link mechanism is connected to a front end of said plunger.

11. A thread cutting device in a sewing machine, comprising:

a movable knife movable across a space between a throat plate and a shuttle positioned below said throat plate so as to perform a thread cutting operation;

a lower thread retreating lever movable from a waiting position to an operative position for retreating a lower thread taken out from said shuttle to a position out of a thread cutting orbit of said movable knife;

the thread cutting device being operable in either a thread cutting mode for cutting both an upper thread and a lower thread or a thread cutting mode for cutting only an upper thread by selectively positioning said lower thread retreating lever at either said waiting position or said operative position during the operation of said movable knife;

an actuator and an interlocking mechanism between said actuator and said lower thread retreating lever for driving said lower thread retreating lever; and control means for controlling said actuator, said control means being operable such that;

prior to the cutting operation, said control means detects a value corresponding to an amount of movement of an embroidery frame after the thread cutting operation;

said control means compares the detected value with a predetermined reference value; and said control means drives said actuator for moving said lower thread retreating lever from said waiting position to said operative position when the detected value is less than said reference value.

12. A thread cutting device in a sewing machine, comprising:

a movable knife movable across a space between a throat plate and a shuttle positioned below said throat plate so as to perform a thread cutting operation;

a lower thread retreating lever movable from a waiting position to an operative position for retreating a lower thread taken out from said shuttle to a position out of a thread cutting orbit of said movable knife;

the thread cutting device being operable in either a thread cutting mode for cutting both an upper thread and a lower thread or a thread cutting mode for cutting only an upper thread by selectively positioning said lower thread retreating lever at either said waiting position or said operative position during the operation of said movable knife;

an actuator and an interlocking mechanism between said actuator and said lower thread retreating lever for driving said lower thread retreating lever, said actuator and said interlocking mechanism being positioned rearwardly of said shuttle; and control means for controlling said actuator, said control means being operable such that;

prior to the cutting operation, said control means detects a value corresponding to an amount of movement of an embroidery frame after the thread cutting operation;

said control means compares the detected value with a predetermined reference value; and said control device drives said actuator for moving the lower thread retreating lever from said waiting position to said operative position when the detected value is less than said reference value.

* * * * *